US010781653B2

(12) United States Patent
Sunde et al.

(10) Patent No.: US 10,781,653 B2
(45) Date of Patent: Sep. 22, 2020

(54) METHOD OF REMOVING A DOWNHOLE CASING

(71) Applicant: ARDYNE HOLDINGS LIMITED, Aberdeen, Aberdeenshire (GB)

(72) Inventors: Frode Sunde, Aberdeen (GB); Edwin Rooyakkers, Aberdeen (GB); Arnstein Wathne, Aberdeen (GB); Steffen Hansen, Aberdeen (GB); Steffen Evertsen, Tanager (NO); Eirik Enerstvedt, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 16/346,414

(22) PCT Filed: Nov. 2, 2017

(86) PCT No.: PCT/GB2017/053298
§ 371 (c)(1),
(2) Date: Apr. 30, 2019

(87) PCT Pub. No.: WO2018/083473
PCT Pub. Date: May 11, 2018

(65) Prior Publication Data

US 2019/0257168 A1 Aug. 22, 2019

(30) Foreign Application Priority Data

Nov. 4, 2016 (GB) ..... 1618612.4

(51) Int. Cl.
*E21B 29/00* (2006.01)
*E21B 23/01* (2006.01)
(Continued)

(52) U.S. Cl.
CPC ..... *E21B 29/005* (2013.01); *E21B 23/01* (2013.01); *E21B 29/00* (2013.01); *E21B 29/002* (2013.01);
(Continued)

(58) Field of Classification Search
CPC ..... E21B 23/01; E21B 29/00; E21B 29/02; E21B 29/005; E21B 31/16; E21B 31/20; E21B 33/13
See application file for complete search history.

(56) References Cited

U.S. PATENT DOCUMENTS 5,101,895 A * 4/1992 Gilbert ..... E21B 23/006 166/55.8
5,318,115 A * 6/1994 Rouse ..... E21B 4/02 166/361
(Continued)

FOREIGN PATENT DOCUMENTS

GB 1590454 A 6/1981
GB 2533022 A 6/2016
(Continued)

OTHER PUBLICATIONS

UK Search Report dated Feb. 28, 2018 for GB1718126.4.
International Search Report dated Feb. 1, 2018 for PCT/GB2017/053298.

*Primary Examiner* — Christopher J Sebesta
(74) *Attorney, Agent, or Firm* — Law Office of Jesse D. Lambert, LLC

(57) ABSTRACT

Method and apparatus for removing a downhole casing from a well on a single trip. A downhole tool assembly is arranged on a work string having a downhole pull tool, a spear tool, motor unit and cutting device. The downhole pull tool is set inside a first casing string and the spear tool, motor unit and cutting device are located inside a second casing string, located through the first casing string. The downhole pull
(Continued)

tool and spear tool can be configures to grip the respective casings during cutting of the second casing string. The cut casing section can then be pulled using the downhole pull tool to dislodge the casing section, whereupon via attachment to the spear tool, the cut casing section can be removed from the well. The assembly can be re-set at shallower depths in the event that the cut casing section cannot be dislodged for removal.

14 Claims, 7 Drawing Sheets

(51) Int. Cl.
*E21B 31/16* (2006.01)
*E21B 31/20* (2006.01)
*E21B 33/13* (2006.01)

(52) U.S. Cl.
CPC ..... *E21B 31/16* (2013.01); *E21B 31/20* (2013.01); *E21B 33/13* (2013.01)

(56) References Cited

U.S. PATENT DOCUMENTS

| | | | | |
|---|---|---|---|---|
| 2002/0060076 | A1* | 5/2002 | Harrell | E21B 23/00 166/340 |
| 2008/0156494 | A1* | 7/2008 | Abadie | E21B 29/00 166/298 |
| 2015/0226031 | A1 | 8/2015 | Hekelaar | |
| 2016/0076327 | A1* | 3/2016 | Glaser | E21B 31/20 166/301 |
| 2016/0215580 | A1 | 7/2016 | Lehr | |
| 2018/0100373 | A1* | 4/2018 | Kruger | E21B 29/002 |

FOREIGN PATENT DOCUMENTS

| | | | | |
|---|---|---|---|---|
| WO | 2005052304 | A1 | 6/2005 | |
| WO | 2011031164 | A1 | 3/2011 | |
| WO | WO 2011/031164 | * | 3/2011 | E21B 31/16 |
| WO | 2013073949 | A1 | 5/2013 | |
| WO | 2014018642 | A1 | 1/2014 | |

* cited by examiner

METHOD OF REMOVING A DOWNHOLE CASING

The present invention relates to methods and apparatus for abandoning wells when they have come to the end of their working life, and in particular to methods and apparatus for removing a downhole casing from a wellbore.

BACKGROUND TO THE INVENTION

During construction of an oil or gas well a wellbore is drilled to a first pre-determined depth. A first casing string is run into the well and is secured in position using cement. The drill string is lowered into the first casing string and the wellbore is extended to a second predetermined depth. A second casing string is then run into the well and is secured in position using cement.

This process of drilling, running a casing and cementing is repeated with successively smaller drilled holes and casing sizes until the well reaches its target depth. At this point, a long production tubing is run into the well.

During production, hydrocarbons flow through the production tubing and are collected at surface. Over time, which may be several decades, the production of hydrocarbons reduces until the production rate of the well is no longer economically viable. At this stage the well is plugged and abandoned.

During a plug and abandonment operation it is often desirable to remove casing strings which have been positioned in the wellbore. The conventional approach to removing well casings involves a number of downhole tasks to cut the casing at multiple positions and further downhole trips to remove the casings in individual stages. This can be a time consuming and expensive process especially if a section casing remains immovable after a casing has been cut.

SUMMARY OF THE INVENTION

It is an object of an aspect of the present invention to obviate or at least mitigate the foregoing disadvantages of prior art casing removal methods.

It is another object of an aspect of the present invention to provide a method for removing a casing from a wellbore which can be performed in a single downhole trip and allows the maximum length of casing to be removed in a single trip.

It is a further object of an aspect of the present invention to provide a reliable, quick and cost efficient method of removing a casing from a wellbore.

Further aims of the invention will become apparent from the following description.

According to a first aspect of the invention there is provided a method of removing a casing from a well comprising providing:

a downhole tool assembly, the downhole tool assembly comprising:

a downhole pull tool;

a spear tool;

a motor unit; and a cutting device;

lowering the downhole tool assembly into the well;

cutting a casing;

gripping the casing; and pulling the cut casing to dislodge the cut casing.

The method may comprise providing the downhole tool assembly on a work string.

The method may comprise rotating the cutting device to cut the casing. The method may comprise actuating the motor unit to rotate the cutting device to cut the casing. The method may comprise actuating the spear tool and/or downhole pull tool to grip the casing. The method may comprise actuating the downhole pull tool to pull the work string and the cut casing section to dislodge the cut casing section.

The method may comprise actuating the downhole pull tool and/or spear tool to grip the casing during the casing cutting operation. The method may comprise actuating the downhole pull tool and/or spear tool before actuating the motor unit and/or cutting device. The method may comprise actuating the motor unit and/or cutting device before actuating the downhole pull tool and/or spear tool. The method may comprise actuating the downhole pull tool, spear tool, motor unit and cutting device simultaneously.

The method may comprise actuating the downhole pull tool and/or spear to grip the casing to hold the downhole pull tool, spear and/or motor unit stationary whilst the cutting device is rotated.

The method may comprise actuating the cutting device by pumping a fluid into a through bore of the work string. The method may comprise deploying at least one knife in the cutting device. The cutting device may be rotated by the motor converting hydraulic fluid force into mechanical force. The cutting device may be rotated by the motor unit converting hydraulic fluid force into a mechanical rotary force to rotate the cutting device.

The method may comprise actuating a piston member on the downhole pull tool between an extended and retracted position. The method may comprise actuating an anchor mechanism on the downhole pull tool between a set and unset position. The method may comprise actuating the anchor mechanism to a set position to grip the casing when the at least one piston member moves from an extended position to a retracted position.

The method may comprise actuating the anchor mechanism to an unset position to release the downhole pull tool from the casing when the at least one piston member moves from a retracted position to an extended position.

The method may comprise sequentially actuating the at least one piston member between an extended position and a retracted position to pull the work string in an upward direction in the wellbore.

The method may comprise releasing the anchor mechanism from the casing if the downhole pull tool is unable to move and/or dislodge the cut casing.

The method may comprise moving the downhole tool assembly to a second desired depth in the wellbore. The second desired depth may be a higher axially position in the wellbore than the previous depth.

The method may comprise actuating the motor unit to rotate the cutting device to cut the casing and actuating the spear tool to grip the casing at the second desired depth. The method may comprise pulling the work string and the cut casing using the downhole pull tool at the second desired depth to move or dislodge the cut casing.

The method may comprise pulling the work string and the cut casing using the downhole pull tool in the wellbore at the second desired depth to remove the casing from the wellbore.

The method may comprise a further cutting and pulling step if the casing remains immovable due to cement between the casing and the wellbore or a blockage. The method may comprise moving the downhole tool assembly to a further desired depth. The further desired depth may be closer to the surface in the wellbore than the first and/or second desired depth.

The method may comprise actuating the cutting device to cut the casing and actuating the spear tool to grip the casing at the further desired depth. The method may comprise actuating the downhole pull tool at the further desired depth to pull the work string and cut casing upward in the wellbore.

The method may comprise monitoring the fluid pressure circulating through the work string to determine when the cutting device, motor unit, downhole pull tool and/or spear tool are activated.

The method may comprise extracting the work string and the attached cut casing section from the wellbore by a rig applying an upward force on the work string when the cut casing has been dislodged.

The work string and the attached cut casing may be extracted when the rig at surface is capable of applying sufficient pulling force on the work string.

The method may comprise actuating the downhole pull tool after the cut casing has been dislodged to pull the work string and cut casing upwards in the wellbore.

According to a second aspect of the invention there is provided a downhole tool assembly for removing a casing from a well comprising:

a downhole pull tool;
a spear tool;
a motor unit; and
a cutting device;
wherein the motor unit is configured to rotate the cutting device.

Preferably the downhole pull tool and spear tool are configured to grip a downhole casing.

By providing a downhole pull tool and spear tool that is capable of engaging and gripping the internal diameter of the casing, the downhole pull tool and/or spear may grip a section of the casing while the cutting device is rotated to cut the casing. This may facilitate a clean cut through the casing and mitigate or avoid damage to the cutting device.

The spear tool may be configured to grip a first casing string and the downhole pull tool may be configured to grip a second casing string. By providing an assembly capable of gripping a first and second casing strings the casing strings may be secured locally to one another preventing or mitigating vibration during a casing cutting operation.

Preferably the downhole tool assembly is located on a work string. Preferably the work string has a throughbore.

Preferably the spear tool is hydraulically settable. The spear tool may comprise at least one slip. The at least one slip may be circumferentially disposed about a section of the spear. Preferably, the at least one slip is configured to engage the inner surface of the casing.

The at least one slip may be resettable. The one slip may be configured to grip the inside diameter of a first section of casing, wherein at least one slip may be subsequently released and reset inside a second section of casing during the same trip in the well.

Preferably, the spear tool, downhole pull tool and/or motor unit is located above the cutting device when positioned in the wellbore. Preferably, downhole pull tool is located above the spear tool when positioned in the wellbore.

The cutting device may comprise at least one blade or knife. Preferably the cutting device comprises a plurality of knives. The plurality of knives may be circumferentially disposed about the cutting device.

The cutting device may be hydraulically actuated. The cutting device may be actuated by pumping fluid into the work string. Preferably the cutting device comprises at least one knife. The at least one knife may be configured to move in response to fluid pressure.

The motor unit may be hydraulically actuated. Preferably the motor unit is a positive displacement motor. The motor unit may be configured to convert hydraulic force of a pumped fluid through the work string throughbore into a rotary mechanical force to rotate the cutting device. Preferably the motor unit is in mechanical communication with the cutting device.

Preferably the spear tool and/or downhole pull tool are stationary while the cutting device is rotated. The motor unit may be stationary while the cutting device is rotated.

The spear tool may comprise a latching mechanism to prevent accidental release of the spear tool from the casing. The latching mechanism may be actuated by providing an upward force on the work string. The latching mechanism may be de-actuated by providing a downward force on the work string.

Preferably the downhole pull tool comprises an anchor mechanism and at least one piston member.

The anchor mechanism may comprise at least one slip. The at least one slip may be circumferentially disposed about a section of the work string. Preferably, the at least one slip is configured to engage the inner surface of the casing. The at least one slip may be moveable between a set position and an unset position. In the slip set position at least one slip engages the inner diameter of the casing. In the unset condition the slips are moved away from the casing and the downhole pull tool is moveable in the casing annulus. The at least one slip and/or the anchor mechanism is hydraulically operable.

The at least one piston member may be moveable between an extended position and a retracted position. Preferably the at least one piston member is coupled to the work string. The at least one piston member is hydraulically operable.

Preferably the at least one slip in the anchor mechanism is set to grip the casing when the at least one piston member moves between an extended position and a retracted position.

The at least one slip in the anchor mechanism may be set to grip the casing when the at least one piston member moves from an extended position to a retracted position. The at least one slip in the anchor mechanism may be unset to be released from the casing when the at least one piston member moves from a retracted position to an extended position.

The assembly may comprise at least one further downhole tool selected from a drill, milling device, tapered mill, stop sub, bumper sub, axial load operated valve and/or drill collar.

Preferably the downhole pull tool pulls the work string and cut casing section to dislodge or move the cut casing section. The downhole pull tool may pull the work string and cut casing section upward in the wellbore.

Embodiments of the second aspect of the invention may include one or more features of the first aspect of the invention or its embodiments, or vice versa.

According to a third aspect of the invention there is provided a method of removing a casing from a well comprising providing:

a downhole tool assembly on a work string, the downhole tool assembly comprising:
a downhole pull tool;
a spear tool;
a motor unit; and
a cutting device;

lowering the downhole tool assembly into the well;
actuating the motor unit to rotate the cutting device to cut the casing;
actuating the spear tool to grip the casing; and
actuating the downhole pull tool to pull the work string and the cut casing section to dislodge the cut casing section.

Embodiments of the third aspect of the invention may include one or more features of the first or second aspects of the invention or their embodiments, or vice versa.

According to a fourth aspect of the invention there is provided a method of removing a casing from a well comprising providing:
a downhole tool assembly on a work string, the downhole tool assembly comprising:
a downhole pull tool;
a spear tool;
a motor unit; and
a cutting device;
lowering the downhole tool assembly into the well to a first desired depth;
cutting the casing at the first depth;
gripping the casing at the first depth;
pulling the cut casing;
moving the downhole tool assembly to a second desired depth in the wellbore;
cutting the casing at a second desired depth;
gripping the casing at the second desired depth; and
pulling the cut casing to dislodge the cut casing.

The method may comprise actuating the motor unit and rotating the cutting device to cut the casing. The method may comprise actuating the spear tool to grip the casing. The method may comprise actuating the downhole pull tool to pull the work string and the cut casing section to dislodge the cut casing section.

The method may comprise actuating the spear tool and/or downhole pull tool by pumping a fluid into a throughbore of the work string.

The method may comprise actuating the cutting device to deploy at least one knife to an extended cutting position by pumping a fluid into a throughbore of the work string. The method may comprise actuating the cutting device by rotating the cutting device to cut the casing. The cutting device may be rotated by hydraulically actuating the motor unit.

The method may comprise releasing the spear tool and/or downhole pull tool from the casing and raising the downhole tool assembly to the second desired depth. The method may comprise actuating the spear tool and the downhole pull tool to grip the same casing string at the second desired depth. The method may comprise actuating the spear tool and the downhole pull tool to grip different casing strings at the second desired depth.

The method may comprise at least one further cutting step if the casing remains immovable due to cement between the casing and the wellbore or between one casing string and another casing string. The method may comprise moving the downhole tool assembly to a further desired depth. The further desired depth may be an axial position closer to the surface in the wellbore than the first and/or second desired depth.

The method may comprise actuating the spear tool and/or downhole pull tool to grip the casing at a further desired depth and actuating the motor unit and/or cutting device to cut the casing.

The method may comprise actuating the downhole pull tool after the casing has been dislodged to pull the work string and the cut casing section toward the surface.

The method may comprise monitoring the fluid pressure level in the work string throughbore. The method may comprise deactivating the cutting device, motor unit, spear tool and/or downhole pull tool based on the monitored fluid pressure level.

Embodiments of the fourth aspect of the invention may include one or more features of the first to third aspects of the invention or their embodiments, or vice versa.

According to a fifth aspect of the invention there is provided a method of removing a casing from a well comprising providing:
a downhole tool assembly on a work string, the downhole tool assembly comprising:
a downhole pull tool;
a spear tool;
a motor unit; and
a cutting device;
lowering the downhole tool assembly into the well;
actuating the downhole pull tool to grip the casing;
actuating the motor unit to rotate the cutting device to cut the casing;
latching the spear tool to the casing;
actuating the downhole pull tool to pull the cut casing to dislodge the cut casing section.

Embodiments of the fifth aspect of the invention may include one or more features of the first to fourth aspects of the invention or their embodiments, or vice versa.

According to a sixth aspect of the invention there is provided a method of removing a casing from a well comprising providing:
a downhole tool assembly on a work string, the downhole tool assembly comprising:
a downhole pull tool;
a spear tool;
a motor unit; and
a cutting device;
lowering the downhole tool assembly into the well;
gripping a first casing string;
gripping a second casing string;
cutting the second casing string;
pulling the second casing string to dislodge the second casing string.

The method may comprise actuating the downhole pull tool to grip a first casing string. The method may comprise actuating the motor unit to rotate the cutting device to cut the second casing string. The method may comprise setting and/or latching the spear tool to the second casing string to grip the second casing string. The method may comprise actuating the downhole pull tool to pull the work string to dislodge the cut casing section.

The method may comprise actuating the cutting device to deploy at least one knife.

Embodiments of the sixth aspect of the invention may include one or more features of the first to fifth aspects of the invention or their embodiments, or vice versa.

According to a seventh aspect of the invention there is provided a method of using a downhole tool assembly providing:
a downhole tool assembly, the downhole tool assembly comprising:
a downhole pull tool;
a spear tool;
a motor unit; and
a cutting device;
lowering the downhole tool assembly into a well;
actuating the downhole pull tool to grip a casing;

actuating the motor unit to rotate the cutting device to cut the casing;

latching the spear tool to the casing; and actuating the downhole pull tool to pull the work string to dislodge the cut casing section.

The method may comprise actuating the cutting device to deploy at least one knife.

The method may comprise actuating the downhole pull tool to grip a first casing string; and actuating the motor unit to rotate the cutting device to cut a second casing string.

The method may comprise latching the spear tool to the second casing string.

Embodiments of the seventh aspect of the invention may include one or more features of the first to sixth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
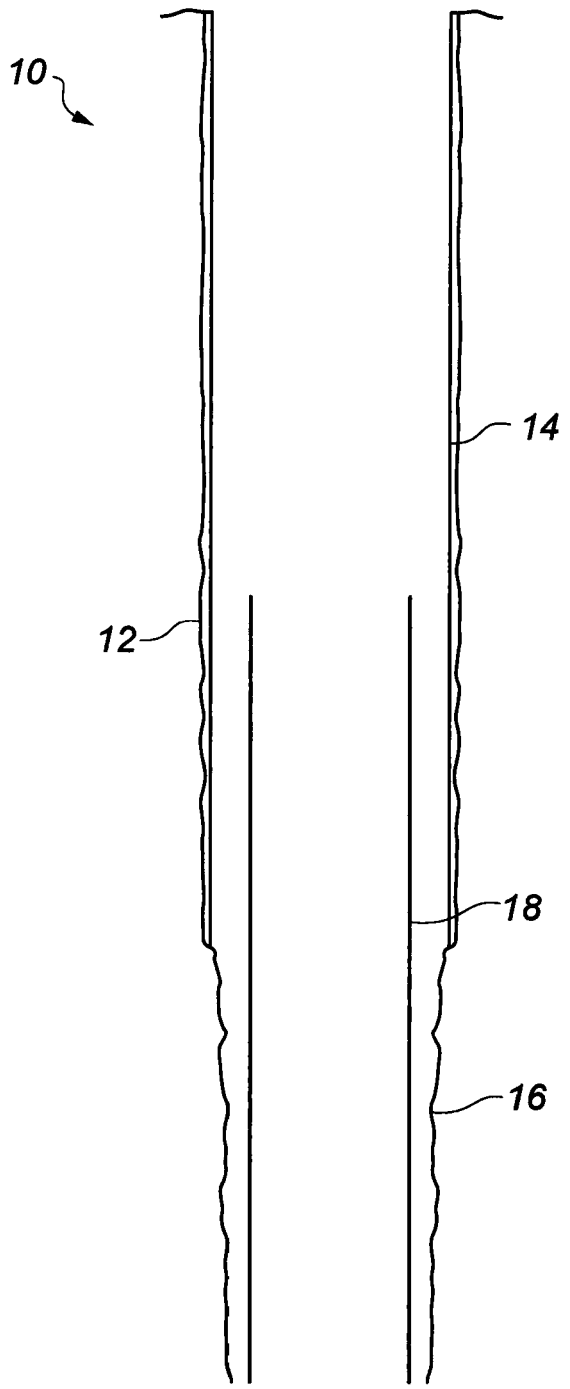
FIG. 1 is a sectional view of a typical well with two casing strings installed.

FIG. 1 shows a typical well 10 with two strings of casing installed. A first section 12 of wellbore 10 is drilled to a first selected depth, after which a first string of casing 14 is run into the well and typically may be a 13⅜ inch casing string. Cement is set over a portion of the outside of the first casing 14, sealing the annulus between the first casing 14 and the first section 12 of wellbore 10.

A second section 16 of wellbore is then drilled to a target depth after the casing 14 is set. A second string of casing 18 is run into the well and typically could be a diameter of 9⅝ inch casing string. The second casing 18 is suspended inside the first casing 14 and cemented to seal the annulus between the second casing 18 and the second section 16 of wellbore 10.

During a well abandonment operation, the second casing 18 or a section of second casing 18 is typically removed before the wellbore is plugged.

FIGS. 2 to 5 are sectional views of a wellbore showing different stages of the casing removal method.

Figure 2:
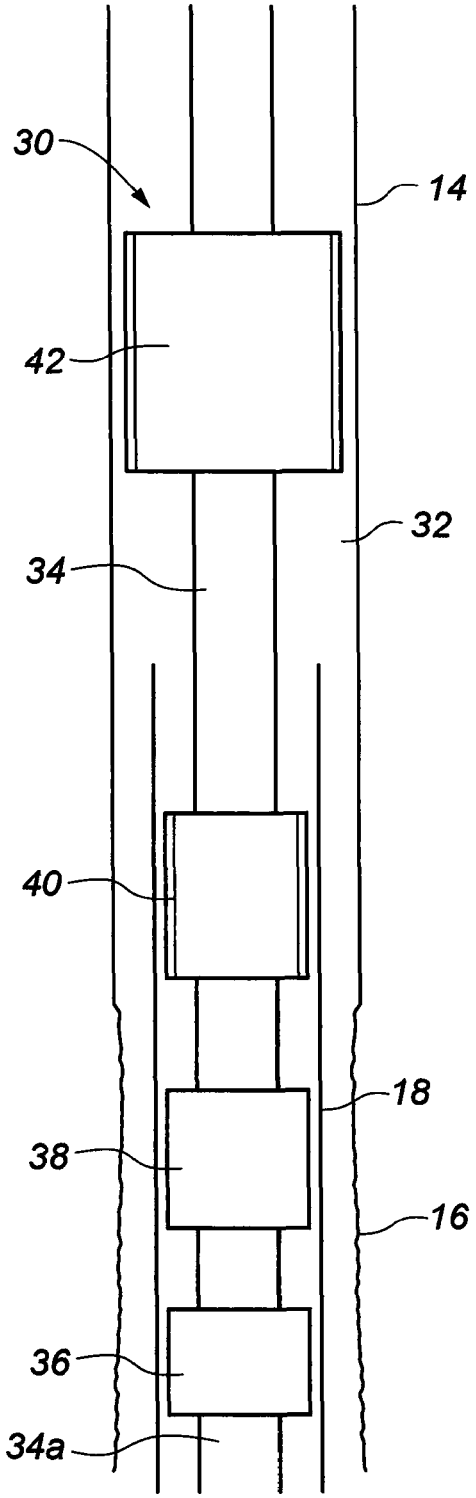
FIG. 2 is a sectional view of the well of FIG. 1 with a downhole tool assembly in a run-in state according to an embodiment of the invention.

FIG. 2 shows a downhole tool assembly 30 lowered into the annulus 32 of the casing 14. In this example the downhole tool assembly is a casing removal assembly.

The downhole tool assembly comprises a work string 34 with a cutting device 36 at a lower end 34*a* of the work string. The work string also comprises a motor unit 38, a spear tool 40 and a downhole pull tool 42.

The downhole pull tool 42 may be a Down Hole Power Tool (DHPT) commercially available from Wellbore AS, Norway.

The cutting device 36 has cutting knives which are configured to radially extend from the cutting device 36 to engage the casing. The cutting device is hydraulically actuatable to deploy the knives in response to a fluid pressure in the work string above a preset threshold. Once the knives are deployed the cutting device is configured to be rotated to cut a section of the casing.

The motor unit 38 is a positive displacement motor configured to convert hydraulic force of a pumped fluid through the work string into a mechanical force to rotate the cutting device 36. The motor unit 38 is run above the cutting device in the well.

The spear tool 40 is run above the motor unit 38 and cutting device 36. The spear tool is hydraulically actuable and the spear is set to grip the casing at or above a preset fluid pressure. The spear tool 40 has slips which are configured to contact the inner diameter of a casing to grip the casing in response to fluid pressure above a preset threshold pressure.

When the spear tool 40 is unset, the work string 34 may be picked up by applying an upward force at surface to position the spear tool 40 at a desired location inside a casing string. When the spear tool 40 is set, the work string 34 is picked up to latch the spear. By picking up the set spear the upward pulling force causes the spear tool slips to be wedged or locked between the body of the spear tool and the casing 18 of the wellbore. At this point the spear tool will maintain its grip on the casing 18 even if the fluid pressure in the work string 34 is reduced below the preset threshold pressure.

The downhole pull tool 42 has an anchor mechanism and a piston member. The anchor mechanism has at least one slip which is moveable between a set position and an unset position. In the anchor set position at least one slip engages the inner diameter of the casing 14. In the unset condition the slips are moved away from casing 14 and the downhole pull tool 42 is moveable in the casing annulus 32.

The piston member of the downhole pull tool 42 is connected to the lower work string and is axially movable between an extended position and a retracted position. In a retracted position the work string below the downhole pull tool is pulled upward in the wellbore.

Figure 3:
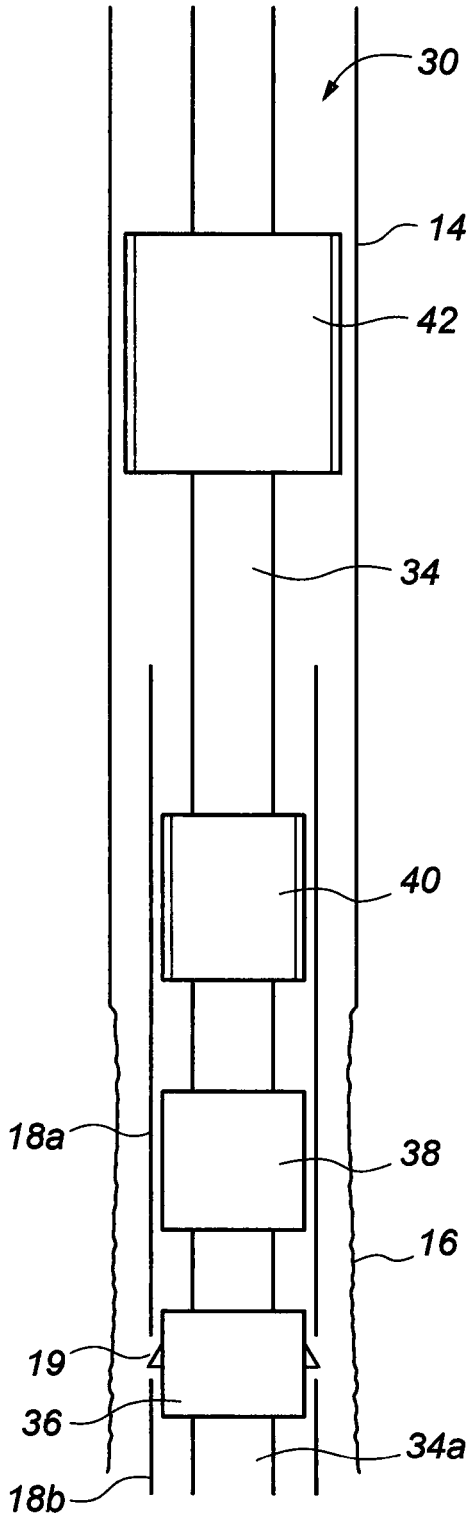
FIG. 3 is a sectional view of the well of FIG. 1 with the downhole tool assembly of FIG. 2 in a casing cutting operational state.

FIG. 3 shows the downhole tool assembly 30 in a casing cutting operation. The work string is lowered to a position where the cutting device 36 is adjacent to a section of casing 18 which is to be cut. Fluid is pumped down the work string 34 to actuate the cutting device to deploy the knives to an extended position to engage the casing.

The fluid flow through the work string creates a differential pressure across the downhole pull tool 42 causing the anchor mechanism to set and grip the first casing string 14. By securing the position of the downhole tool assembly in the wellbore during a casing cutting operation damage to the knives of the cutting device is avoided or mitigated extending the working life of the knives.

The fluid flow through the work string 34 hydraulically actuates the spear tool 40 to grip the casing 18. The fluid pressure actuates the motor unit 38 to rotate the cutting device to allow the cutting device to cut the casing 18 forming a gap 19 in the casing.

The motor unit 38, spear tool 40 and downhole pull tool 42 are held stationary while the cutting device is rotated.

By securing the downhole pull tool to the first casing 14 and the spear tool to the second casing 18 the downhole tool assembly 30 is held rigidly in position during the cutting operation. The position of the first casing 14 and second casing 18 are held relative to one another during the casing cutting operation ensuring a clean cut through the second casing 18 and mitigating damage to the cutting knives.

By providing a downhole pull tool with a motor unit on the same work string the cutting operation and pulling operation may be performed in a single downhole trip.

Figure 4:
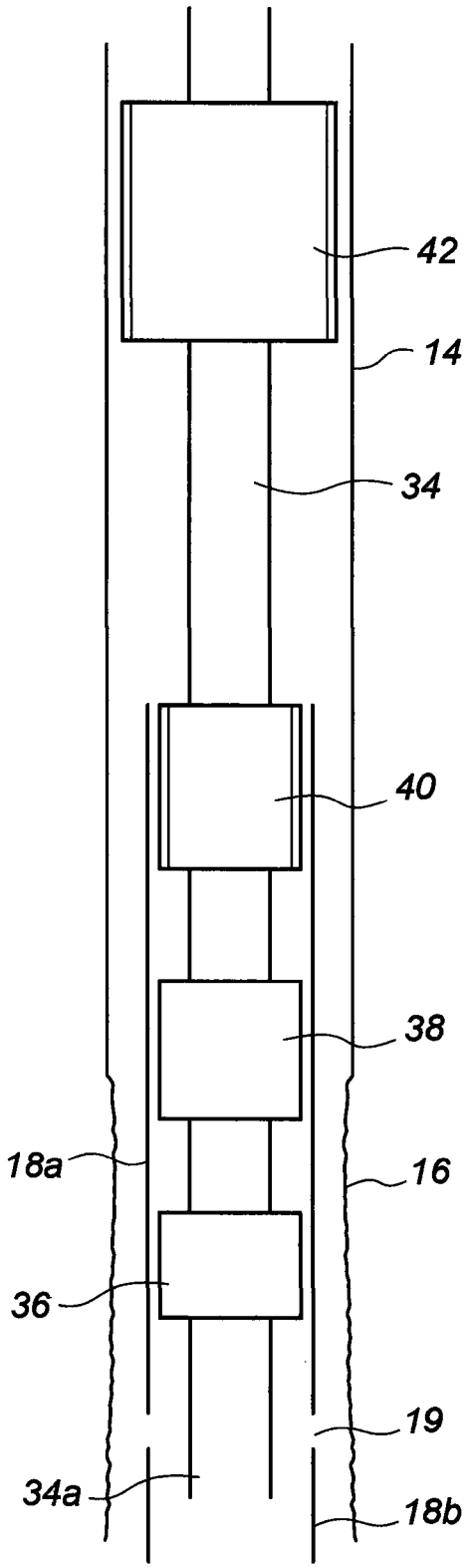
FIG. 4 is a sectional view of the well with the downhole tool assembly of FIG. 2 in a spear tool operational state.

FIG. 4 shows that once the casing cut has been made the work string 34 is picked up to latch the spear tool 40. By picking up the set spear tool, the upward pulling force causes the slips to be wedged or locked between the body of the spear tool and the casing 18 of the wellbore. At this point the spear tool will maintain its grip on the casing even when the fluid pressure is reduced or stopped.

Figure 5:
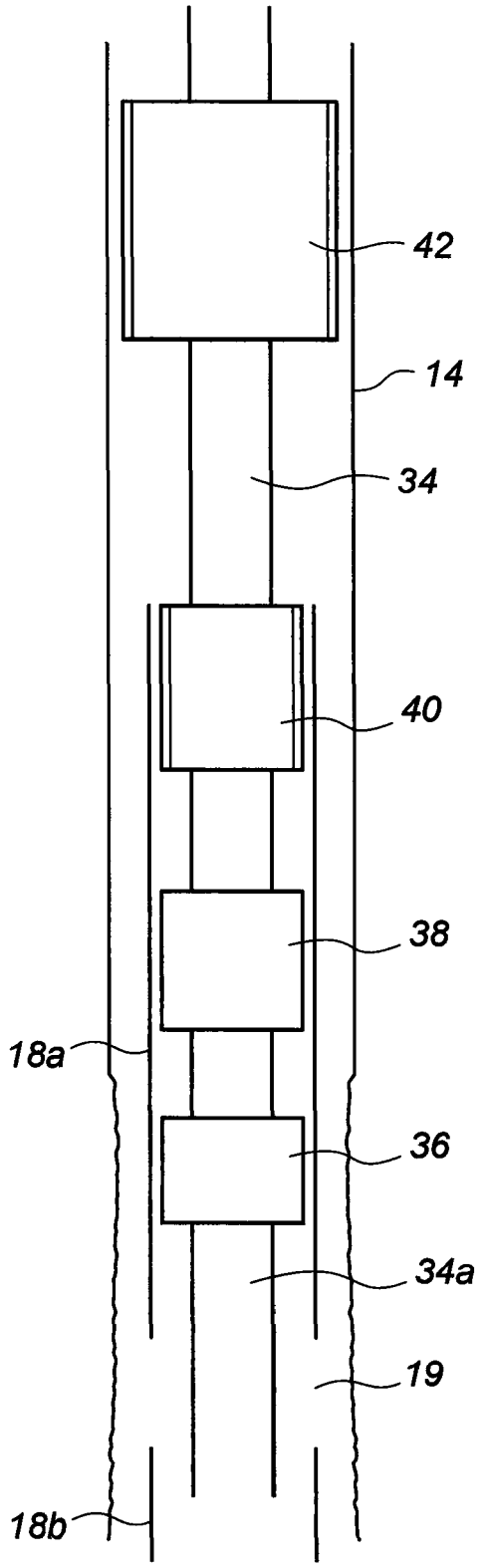
FIG. 5 is a sectional view of the well with the downhole system of FIG. 2 in a pulling state.

FIG. 5 shows the downhole pull tool 42 is actuated to move and dislodge the cut casing section 18*a*. The fluid pressure in the work string is increased to set the anchor mechanism in the downhole pull tool 42 and move the piston member to a retracted or stroked position. The work string 34 below the downhole pull tool 42 and the cut casing section 18*a* is pulled upward towards the anchored downhole pull tool 42. The cut casing section 18*a* is pulled upward to dislodge the casing and move the cut casing section 18*a* away from the remaining section of casing 18*b* increasing the gap 19.

The fluid pressure is reduced to move the anchor mechanism to an unset position and the piston member to an extended or unstroked position. The downhole pull tool 42 is moved to a higher axial position in the casing 14. The fluid pressure is subsequently increased to set the anchor mechanism and move the piston member to a retracted or stroked position which moves the work string 42 and cut casing section 18*a* further upwards.

Figure 6:
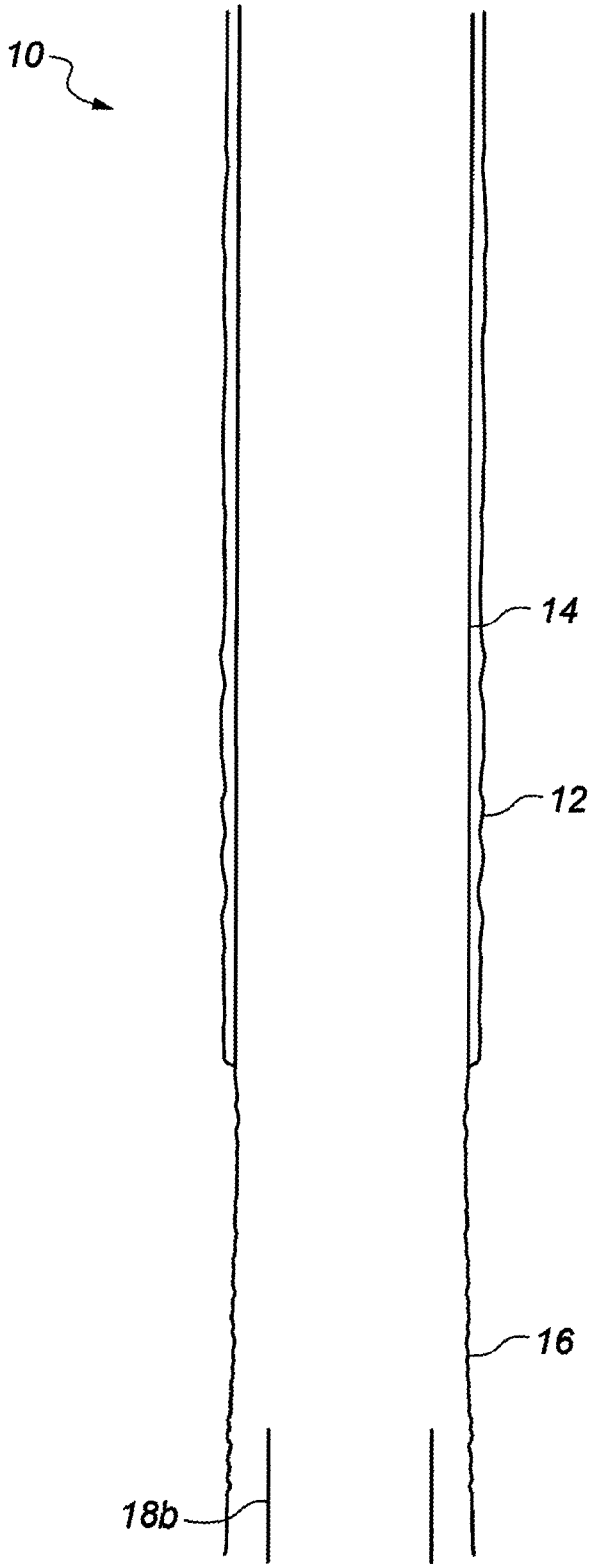
FIG. 6 is a sectional view of the well of FIG. 1 with a casing string removed.

Successive movement of the piston member between a retracted and an extended position moves the work string and cut casing section 18*a* further upward in the wellbore until cut casing section 18*a*. At this point, the rig, to which the work string is connected, has sufficient lifting capacity to remove the work string, downhole assembly and the cut casing section 18*a* from the wellbore. The downhole pull tool 42 is unanchored from the casing 14 and the spear tool 36 remains anchored to the cut casing section 18*a* for the lifting operation. FIG. 6 shows the wellbore with the cut casing section 18*a* and work string 34 removed from the wellbore by a rig.

The downhole pull tool 42 applies a local upward pulling load on the work string 34 and the cut casing section. This mitigates or reduces wear or damage to the work string which may occur if a rig had to apply excessive loads from the surface to dislodge and remove the cut casing section. Once the cut casing section has been dislodged the rig may have sufficient capacity to pull the work string and the casing to surface.

By locating the work string and the downhole tool assembly at the lowest axial position in the wellbore and cutting the casing, the maximum length of cut casing may be removed in a single downhole trip. This avoids multiple trips downhole to remove individual small sections of the casing.

In the event that the cut casing section 18 is immovable due to cement or a blockage between the casing and the wellbore, the work string may be relocated to a higher position in the wellbore and the cutting operation and pulling operation repeated as described above in relation to FIGS. 2 to 6 above. If in this second wellbore axial position the downhole pull tool is unsuccessful in dislodging or lifting the cut casing section, the method of cutting and pulling may be repeated in further axial positions until a cut casing section may be removed.

By systematically checking whether a cut casing section may be removed the maximum length of casing that may be removed is identified and removed.

Although the above description refers to removing casing diameters of 9⅝ inches and 13⅜ inches, the method and apparatus may be used with other casing diameters.

Figure 7:
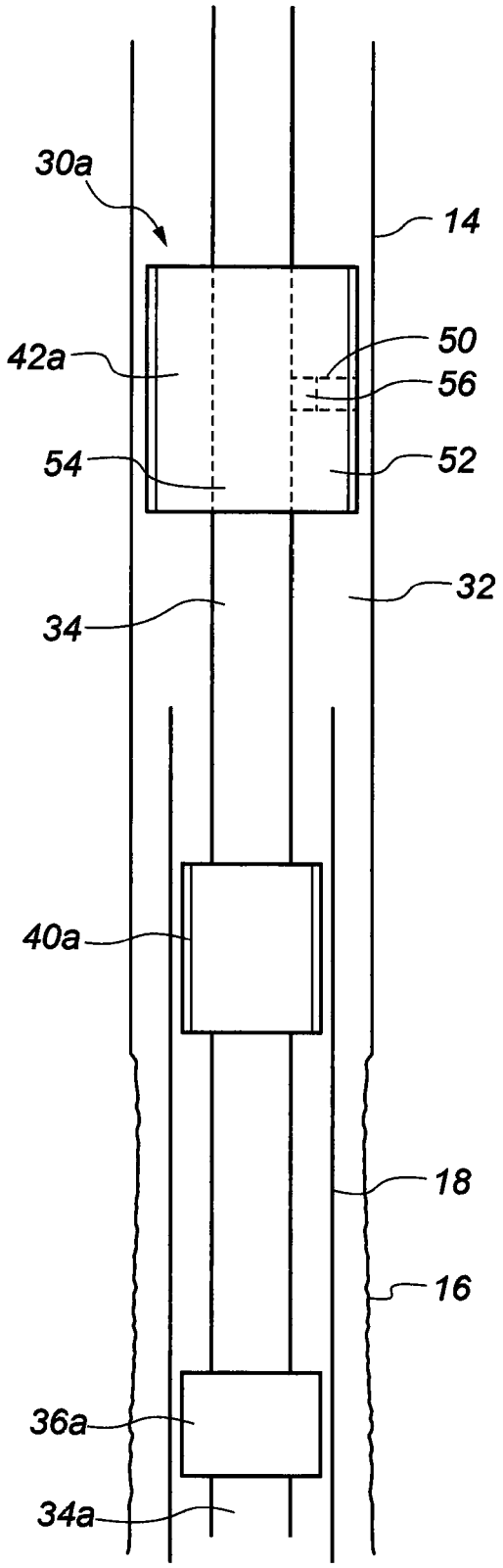
FIG. 7 is a sectional view of the well of FIG. 1 with a downhole tool assembly in a run-in state using a downhole pull tool with through-rotation capability.

Referring to FIG. 7 there is disclosed an alternative downhole tool assembly 30*a* for removing a casing from a well comprising: a downhole pull tool; a spear tool; and a cutting device; wherein the downhole pull tool is configured to provide through rotation capability so that the cutting device can be rotated from surface. Accordingly this would provide a method of removing a casing from a well comprising providing: a downhole tool assembly 30*a*, the downhole tool assembly comprising: a downhole pull tool 42*a* with through rotation capability, a spear tool 40*a* and a cutting device 36*a*; lowering the downhole tool assembly into the well; cutting a casing; gripping the casing; and pulling the cut casing to dislodge the cut casing.

The spear tool 40*a* and cutting device 36*a* are as described with reference to FIGS. 2 to 6. The downhole pull tool 42*a* may be as described herein before with reference to FIGS. 2 to 6 with the addition of a rotational mechanism 50. Such a rotational mechanism will allow an outer body 52 of the downhole pull tool, anchored to the casing, to be held stationary while an inner body 54, typically a mandrel connected in the work string, can rotate. In this way the work string can rotate through the downhole pull tool. The motor unit is therefore not required as the casing cutter 36*a* can be operated to rotate and cut the casing by rotation of the work string 34 at surface. The downhole pull tool 42*a* may contain a bearing 56 in the rotation mechanism 50 to provide the through rotation capability.

It will be realised that during cutting only the anchor on the downhole pull tool 42*a* will be set and the spear tool 40*a* now needs to be unset. The assembly 30*a* will be run in the well until the spear casing cutter 36*a* is in the lower casing string 18. The downhole pull tool 42*a* will be set in the upper casing string 14. By rotation of the work string 34 through the downhole pull tool 42*a*, the casing cutter 36*a* will cut the casing 18 separating it into an upper 18*a* and lower 18*b* portion. Once cutting is complete, the spear tool 40*a* is actuated to grip the cut casing section 18*a*. The assembly may be repositioned in the wellbore to achieve this as it is preferred that the spear tool 40*a* is positioned at the upper end of the cut casing section 18*b*. With the spear tool 40*a* engaged, the work string 34 can be attempted to be lifted from surface. If the cut casing section 18*a* will not move and is stuck, the downhole pull tool 42*a* is actuated to anchor the tool 42*a* to the wall of the upper casing 14. The downhole pull tool 42*a* is further actuated to raise the work string 34 under a high load to jack the cut casing section 18*a* upwards. Pressure through the downhole pull tool 42*a* at surface will indicated if the cut casing section has not, partly or entirely dislodged. If entirely free the cut casing section 18*a* and downhole assembly can be raised to surface if the rig to which it is attached has sufficient pulling capacity. Alternatively, the downhole pull tool 42*a* is unset and the outer body raised to a higher position in the wellbore and the anchor set again. The downhole pull tool 42*a* is further actuated to raise the work string 34 under a high load to jack the cut casing section 18*a* upwards with the downhole assembly 30*a*. these steps can be repeated until the cut casing section 18*a* is dislodged and free, and the rig has sufficient pulling capacity to raise the work string to surface with the downhole assembly 30*a* and the cut casing section 18*a*. As for the embodiment shown in FIGS. 2 to 6, this provides a single trip can and pull system in which stuck casing can be dislodged so that longer lengths of casing can be recovered as compared to casing and pull systems which just comprise the spear tool and the casing cutter.

The downhole tool assembly is described in use in a well borehole lined with a well casing. It will be appreciated that this is only one example use. The tool may be used in other applications in gripping, cutting and removing tubular structures. It will also be appreciated that the downhole tool assembly may be used in other applications in gripping and removing downhole fish.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "lower", "upper, upward, downward, "up" "down" and the like are used herein to indicate directions and locations as they apply to the appended drawings and will not be construed as limiting the invention and features thereof to particular arrangements or orientations.

The invention provides a method of removing a casing from a well. The method comprises providing a downhole tool assembly. The downhole tool assembly comprises a downhole pull tool, a spear tool, a cutting device, and a motor unit. The method comprises lowering the downhole tool assembly into the well and cutting a casing. The method also comprises gripping the casing and pull the cut casing section to dislodge the cut casing.

The present invention obviates or at least mitigates disadvantages of prior art methods of removing casing from a well and reliable, quick and cost efficient method of removing a casing from a wellbore. The invention enables the maximum length of casing to be cut and removed in a single trip.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended

We claim:

1. The method of removing a casing from a well on a single trip, comprising the steps of a) providing a downhole tool assembly on a work string, the downhole tool assembly comprising: a downhole pull tool, the downhole pull tool having an anchor mechanism and a piston member axially moveable between an extended position and a retracted position; a spear tool; a motor unit; and a cutting device;

b) lowering the downhole tool assembly into the well through a first casing wherein the casing to be removed is a second casing located through the first casing in the well;

c) gripping the first casing with the anchor mechanism;

d) cutting the second casing with the cutting device;

e) gripping the second casing with the spear;

f) pulling the cut second casing to dislodge the cut second casing by moving the piston member to the retracted position; and g) removing the cut second casing from the well, wherein:

the motor unit is located between the downhole pull tool and the cutting device;

the motor unit is configured to rotate the cutting device; and the anchor mechanism of the downhole pull tool grips the first casing while the cutting device is rotated by pumping fluid through a throughbore of the work string to operate the motor unit thereby cutting the second casing.

2. The method according to claim 1 wherein the spear tool grips the second casing while the cutting device is rotated to cut the casing.

3. The method according to claim 1 wherein the second casing is cut below the location of the spear tool.

4. The method according to claim 1 wherein at step (d) the pumping of the fluid into a through bore of the work string actuates the cutting device to deploy at least one knife in the cutting device.

5. The method according to claim 1 wherein the method includes the step of actuating the anchor mechanism to a set position to grip the first casing when the piston member moves from an extended position to a retracted position.

6. The method according to claim 5 wherein the method includes the step of actuating the anchor mechanism to an unset position to release the downhole pull tool from the first casing when the piston member moves from a retracted position to an extended position.

7. The method according to claim 6 wherein the method includes the steps of sequentially actuating the piston member between an extended position and a retracted position to pull the work string in an upward direction in the wellbore.

8. The method according to claim 1 wherein, between steps (e) and (f), the method includes the additional steps of, pulling on stuck cut second casing, moving the downhole tool assembly to a shallower depth, and repeating steps (c) to (e) to remove a shorter section of cut second casing.

9. The method according to claim 8, wherein the method includes repeating the additional step to cut the casing at subsequently shallower depths until the casing can be dislodged and removed from the well.

10. The method according to claim 1 wherein step (g) comprises extracting the work string and the attached cut second casing section from the wellbore by a rig applying an upward force on the work string when the cut second casing has been dislodged.

11. The method according to claim 1 wherein the motor unit converts hydraulic force into mechanical force.

12. The method according to claim 1 wherein the motor unit converts hydraulic fluid force into mechanical rotary force to rotate the cutting device.

13. The method according to claim 1 wherein the method includes the step of actuating the anchor mechanism on the downhole pull tool between a set and unset position.

14. The method according to claim 1 wherein the method comprises monitoring fluid pressure circulating through the work string to determine when the cutting device, motor unit, downhole pull tool and/or spear tool are actuated.

* * * * *